US008291616B2

(12) United States Patent
DiGangi

(10) Patent No.: US 8,291,616 B2
(45) Date of Patent: Oct. 23, 2012

(54) INSOLE HAVING A TRANSPARENT PORTION AND A SOCK LINER PORTION

(75) Inventor: Antonio DiGangi, Roseland, NJ (US)

(73) Assignee: LJO, Inc. NJ (US)

( * ) Notice: Subject to any disclaimer, the term of this patent is extended or adjusted under 35 U.S.C. 154(b) by 733 days.

(21) Appl. No.: 12/378,455

(22) Filed: Feb. 14, 2009

(65) Prior Publication Data

US 2010/0205828 A1 Aug. 19, 2010

(51) Int. Cl.
*A43B 13/38* (2006.01)
*A43B 13/00* (2006.01)

(52) U.S. Cl. ..... 36/44; 36/71

(58) Field of Classification Search ..... 36/43, 44, 36/10, 71, 103; 12/142 R
See application file for complete search history.

(56) References Cited

U.S. PATENT DOCUMENTS

| | | | | | |
|---|---|---|---|---|---|
| 4,628,936 | A * | 12/1986 | Langer et al. | ..... | 36/173 |
| 4,715,131 | A * | 12/1987 | Kremendahl | ..... | 36/44 |
| 4,931,773 | A * | 6/1990 | Rosen | ..... | 340/573.1 |
| 5,014,041 | A * | 5/1991 | Rosen | ..... | 340/573.1 |
| 2005/0060910 | A1 * | 3/2005 | Kaneda et al. | ..... | 36/43 |
| 2008/0289219 | A1 * | 11/2008 | Nakano | ..... | 36/88 |

* cited by examiner

*Primary Examiner* — Jila M Mohandesi
(74) *Attorney, Agent, or Firm* — Baker & Hostetler LLP

(57) ABSTRACT

Insoles with sock liners are provided for shoes. An insole in accordance with the invention is most useful in a shoe that has a transparent portion in its sole, although it is not required to be used in that type of shoe. The insole is formed of at least two portions a window and a sock liner. In some embodiments the sock liner also acts as an insole board. In other embodiments the sock liner is in addition to the insole board.

13 Claims, 5 Drawing Sheets

INSOLE HAVING A TRANSPARENT PORTION AND A SOCK LINER PORTION

FIELD OF THE INVENTION

The invention relates generally to shoes and, more particularly, to sock liners for shoes having at least one transparent portion in the sole.

BACKGROUND OF THE INVENTION

Shoes exist, which include transparent portions in their bottoms. An example of such a shoe can be found in U.S. Pat. No. 4,931,773 to Rosen. The purpose of the transparent portions are for better determining the fit of the shoe; particularly for children.

In the shoe disclosed in the Rosen patent, various insole embodiments are described. For example, an embodiment is described, which includes a transparent insole with a partially covering opaque sock. The transparent insole is essentially the shape and size of the shoe bottom. In other disclosed embodiments, the insole includes a layer of translucent slow recovery foam or gel for taking an imprint of the child's foot. In these embodiments the transparent insole is also essentially the shape and size of the shoe bottom.

It would be advantageous to provide, for a shoe having at least one transparent portion in the bottom, an insole having only a portion being transparent. It would also be advantageous to provide an insole having a shaped sock liner to provide orthodic support. It could be further advantageous to provide a transparent insole having a sprayed on sock liner. It could also be advantageous to have a transparent insole with a decorative sock liner silk screened to the insole. It could be still further advantageous to provide a transparent insole with stitching as the sock liner.

BRIEF SUMMARY OF THE INVENTION

Many advantages of the invention will be determined and are attained by the invention, which in a broadest sense provides, for a shoe having at least one transparent portion in the bottom, an insole having at least a portion being transparent. Implementations of the invention may provide one or more of the following features.

An aspect of the invention provides an insole for a shoe. The shoe has an inside, a front toe portion and a rear heal portion. The insole includes a transparent window configured to fit within the shoe at a location that is proximal the toe portion. The transparent window also has a front side, rear side, top and bottom. The rear side is configured to face the rear heal portion of the shoe. The insole also includes an insole board connected to the rear side of the transparent window.

Another aspect of the invention provides an insole for a shoe that has an inside, a front toe portion, a rear heal portion, a sole and a clear portion within the sole. The insole includes a window configured to fit within the shoe at a position correlating to the clear portion of the sole. The window has a rear side facing the rear heal portion of the shoe. The insole also includes an insole board connected to the window at the rear side of the window.

In another aspect of the invention an insole is provided for a shoe. The shoe has an inside, a front toe portion, a rear heal portion, a sole and a clear portion within the sole. The insole includes a transparent insole board, which has a top portion is configured to fit within the shoe. The insole also includes a sock liner sprayed on to at least a portion of the top of the insole board.

In yet another aspect of the invention an insole is provided for a shoe. The shoe has an inside, a front toe portion, a rear heal portion, a sole and a clear portion within the sole. The insole includes a transparent insole board, which has a top portion is configured to fit within the shoe. The insole also includes a sock liner formed of stitching on at least a portion of the top of said insole board.

In still another aspect of the invention an insole is provided for a shoe. The shoe has an inside, a front toe portion, a rear heal portion, a sole and a clear portion within the sole. The insole includes a transparent insole board, which has a top portion is configured to fit within the shoe. The insole also includes a sock liner silk screened on to at least a portion of the top of said insole board.

In another aspect of the invention an insole is provided for a shoe. The shoe has an inside, a front toe portion, a rear heal portion, a sole and a clear portion within the sole. The insole includes a transparent insole board, which has a top portion is configured to fit within the shoe. The insole also includes a sock liner heat sealed to at least a portion of the top of said insole board, said sock liner including a plurality of polyurethane pods.

In another aspect of the invention, a method is provided of attaching an insole to a shoe, wherein the shoe includes an upper and the insole is formed by an insole board connected to a side of a transparent window element. The method includes stitching the window to the upper, and connecting the insole board to the upper.

The invention will next be described in connection with certain illustrated embodiments and practices. However, it will be clear to those skilled in the art that various modifications, additions and subtractions can be made without departing from the spirit or scope of the claims.

BRIEF DESCRIPTION OF THE DRAWINGS

For a better understanding of the invention, reference is made to the following description, taken in conjunction with the accompanying drawings, in which like reference characters refer to like parts throughout, and in which.

Figure 1:
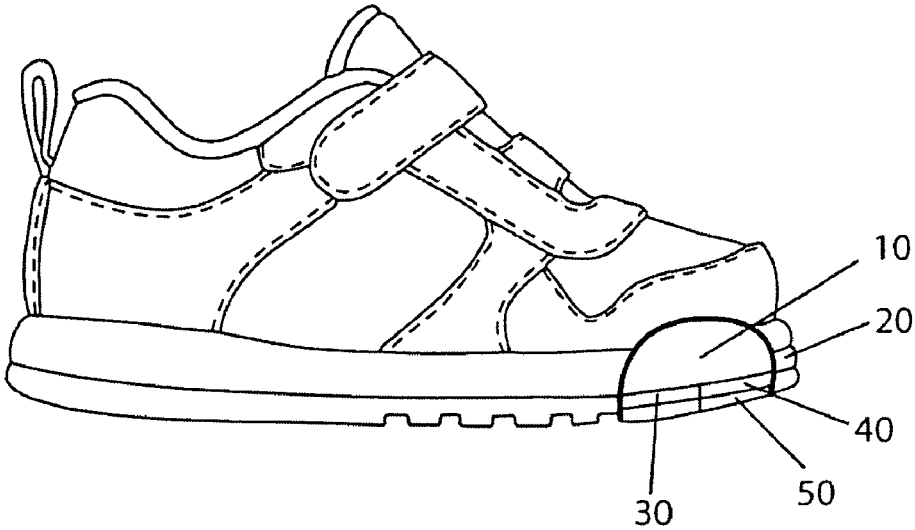
FIG. 1 is a side elevation partially cutaway view of a shoe embodying principles of the invention.

The invention will next be described in connection with certain illustrated embodiments and practices. However, it will be clear to those skilled in the art that various modifications, additions, and subtractions can be made without departing from the spirit or scope of the claims.

DETAILED DESCRIPTION OF THE INVENTION

Referring to the drawings in detail wherein like reference numerals identify like elements throughout the various figures, there is illustrated in FIGS. 1-15 insoles for shoes with at least a portion of the bottom being transparent according to the invention. The principles and operations of the invention may be better understood with reference to the drawings and the accompanying description.

The term "shoe," is used herein in its broadest sense and shall refer to any shoe sneaker, boot, slipper or the like. The term "insole" is also being used in its broadest sense and is being used in accord with its ordinary dictionary meaning. The term "sock liner" is being used to mean a substance or material that provides added friction and/or comfort to the insole. The terms "clear" and "transparent" are being used in the broadest sense and include both see-through and partially see-though.

Embodiments of the invention provide insoles with sock liners for shoes. An insole in accordance with the invention is most useful in a shoe that has a transparent portion in its sole. However, those skilled in the art will recognize that the insoles could be employed in any shoe and still fall within the scope of the invention.

FIG. 1 illustrates a shoe having both a transparent portion 50 in its sole and an insole in accordance with the invention. While FIG. 1 illustrates insole 10 as having two distinct portions 30 and 40 it will be seen from the following description of the various embodiments of the invention that insole 10 could also include a singular portion that runs the length of the shoe.

Figure 2:
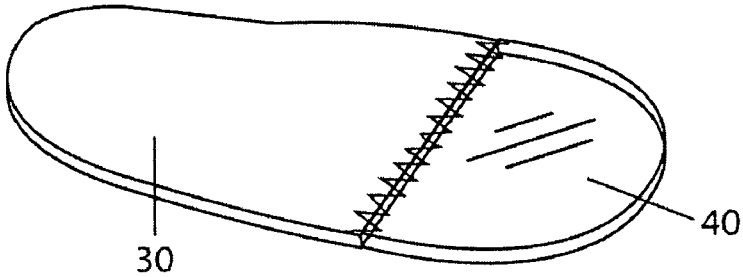
FIG. 2 is a plan view of an insole of the shoe of FIG. 1 in accordance with embodiments of the invention.
Figure 3:
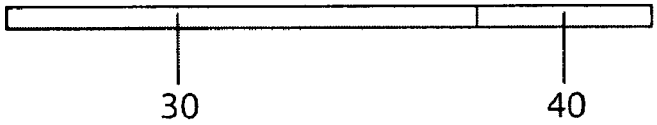
FIG. 3 is a side view of the insole of FIG. 1.
Figure 18:
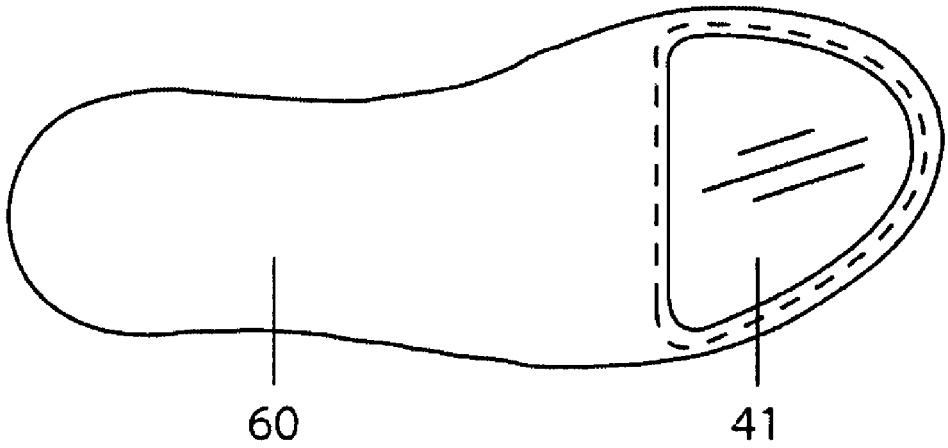
FIG. 18 is a plan view of an insole of the shoe of FIG. 1 in accordance with embodiments of the invention.

FIGS. 2 and 3 illustrate a preferred embodiment of the invention. As illustrated, in the embodiment of FIGS. 2 and 3, insole 10 is formed from a sock liner 30 and a transparent window 40, which is configured to coincide, either entirely or at least partially, with window 50 in the sole of the shoe. In this embodiment, sock liner 30 and window 40 each have the same thickness such that when they are connected they form a relatively planar upper surface and the combination of the two elements forms the entire insole. Preferably, sock liner 30 and window 40 are stroble stitched together, however, those skilled in the art will recognize that any method of connecting the two elements in such a way that they form a planar surface is intended to fall within the scope of the invention. Alternatively, as illustrated in FIG. 18, window 40 (41 in FIG. 18) could be placed and sewn into a void in sock liner 30. Those skilled in the art will recognize that the embodiment illustrated in FIG. 18 could be constructed with an insole board having a void or a sock liner, having a void, acting as an insole board. In the event that the construction includes an insole board, it is considered within the scope of the invention to also employ a sock liner as described with regard to various other embodiments of the invention.

Figure 14:
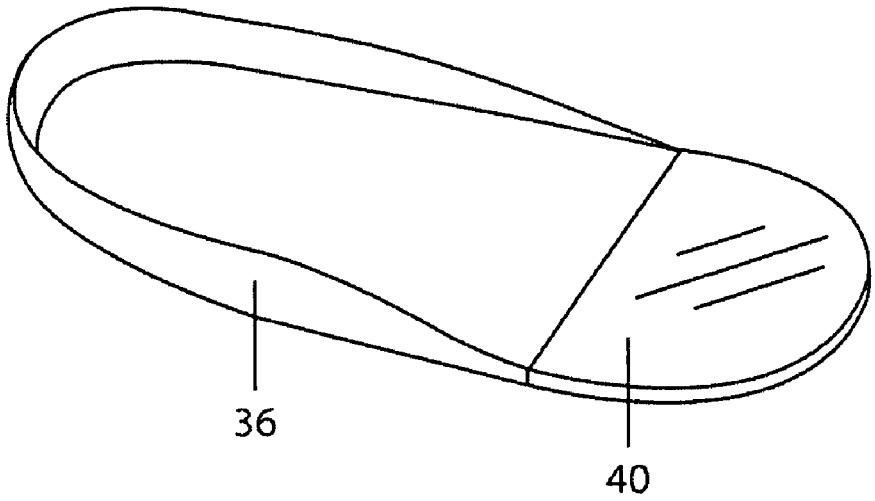
FIG. 14 is a perspective view of another alternative insole of the shoe of FIG. 1 in accordance with embodiments of the invention.
Figure 15:
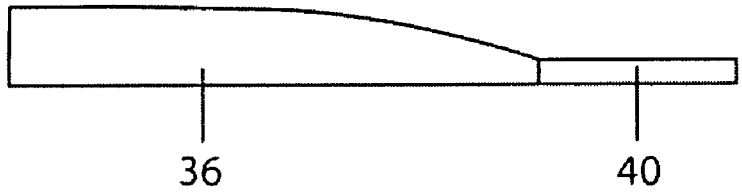
FIG. 15 is a side view of the insole of FIG. 14.

FIGS. 14 and 15 illustrate a similar embodiment to that illustrated in FIGS. 1 and 2, wherein insole 10 is formed from a sock liner 36 and a transparent window 40, which is configured to coincide, either entirely or at least partially, with window 50 in the sole of the shoe. In this embodiment, at least a portion of sock liner 36 and window 40 each have the same thickness such that when they are connected they form a relatively planar upper surface and the combination of the two elements forms the entire insole. The embodiment of FIGS. 14 and 15 differ from that of FIGS. 1 and 2 in that the sock liner 36 of FIGS. 14 and 15 includes a raised wall portion, which forms a support for the heal of a foot. While it has been illustrated as surrounding the entire perimeter of sock liner 36, those skilled in the art will recognize that only a portion of the perimeter could be raised or just the sides or just the back could be raised without departing from the scope of the invention. While the embodiments described in relation to FIGS. 1-4 and 18 all include a substantially flat sock liner 30 and clear window 40, it is possible that either or both of these elements could be generally wedge shaped with a thickness that tapers towards the front or toe portion of the element(s). It is also possible that the sock liner in either or both of these embodiments could include a thick portion which acts as an arch support (not shown).

FIGS. 4-7 illustrate alternative embodiments of the invention. In these embodiments, an insole board 60 is connected to transparent window 40. At either the same location as the connection or proximal the same location a sock liner 31 (FIGS. 4 and 5) or 32 (FIGS. 6 and 7) is also connected. Preferably, sock line 31 or 32 is only connected by the leading or front edge such that when pressure is applied by a foot in the shoe, sock liner 31 or 32 contacts all (FIGS. 4 and 5) or part of (FIGS. 6 and 7) insole board 60. Those skilled in the art will also recognize that sock liner 31 or 32 could be stitched to insole board 60 around the entire perimeter of sock liner 31 or 32, portions of the perimeter, across the face of sock liner 31 or 32, or all or part of sock liner 31 or 32 could be cemented/glued to insole board 60 and still fall within the scope of the invention.

Figure 4:
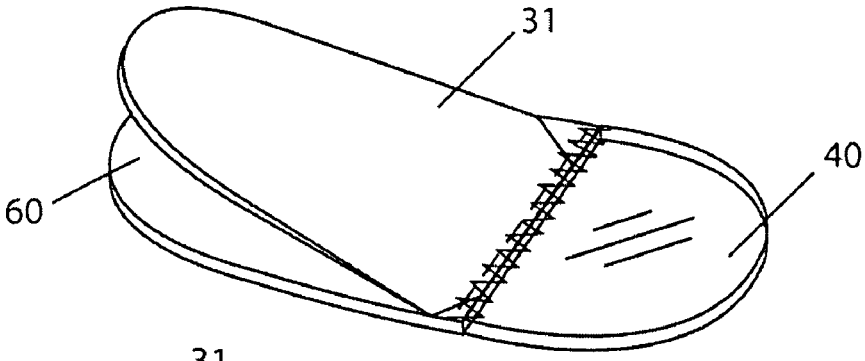
FIG. 4 is a perspective view of an alternative insole of the shoe of FIG. 1 in accordance with embodiments of the invention.
Figure 5:
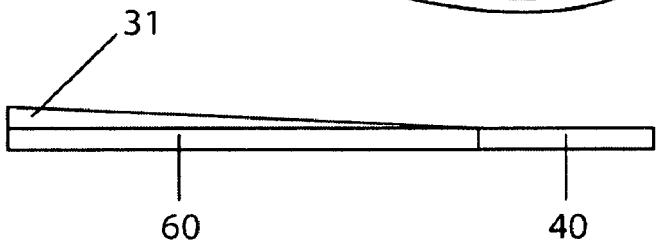
FIG. 5 is a side view of the insole of FIG. 4.
Figure 6:
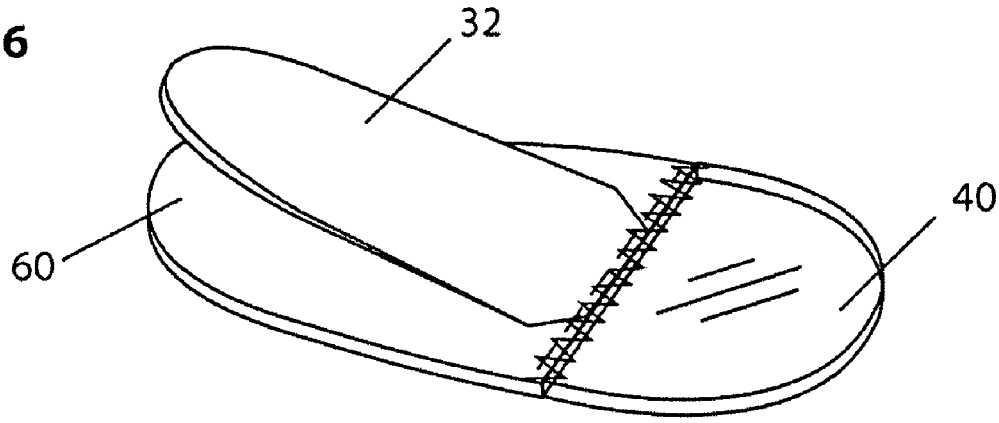
FIG. 6 is a perspective view of another alternative insole of the shoe of FIG. 1 in accordance with embodiments of the invention.
Figure 7:
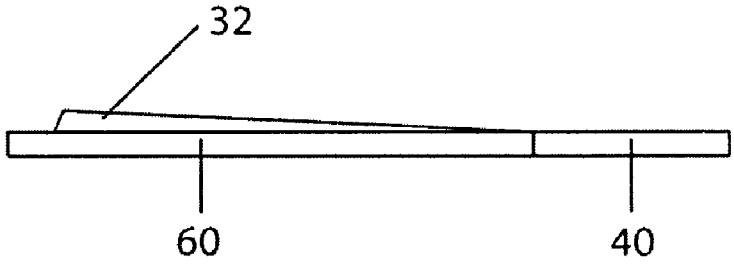
FIG. 7 is a side view of the insole of FIG. 6.
Figure 8:
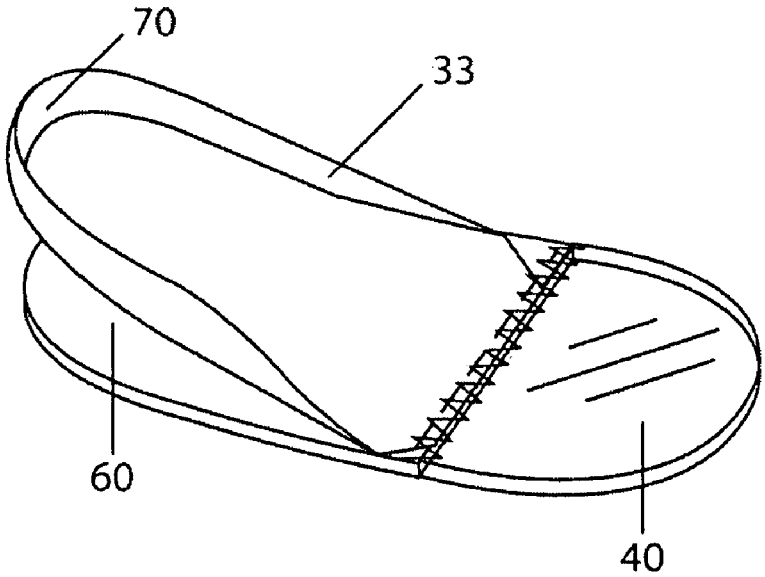
FIG. 8 is a perspective view of still another alternative insole of the shoe of FIG. 1 in accordance with embodiments of the invention.
Figure 9:
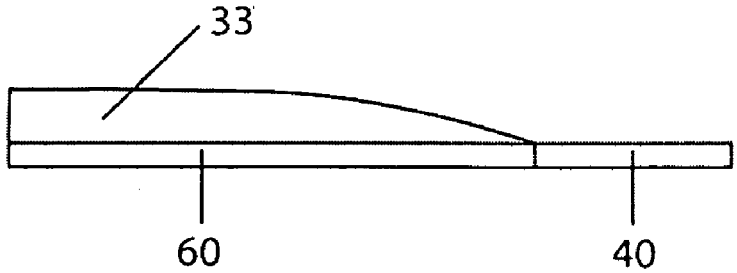
FIG. 9 is a side view of the insole of FIG. 8.

The embodiments illustrated in FIGS. 8 and 9 are similar to those of FIGS. 4 and 5. In these embodiments, however, sock liner 33 includes a raised wall portion 70, which forms a support for the heal of a foot. While wall portion 70 has been illustrated as surrounding the entire perimeter of sock liner 33, those skilled in the art will recognize it could be contiguous or broken, could surround only a portion of the perimeter or the entire outer perimeter (as illustrated), or just the sides or just the back could be raised without departing from the scope of the invention. It is also possible that the sock liner illustrated in any or all of FIGS. 4-9 could include a thick portion which acts as an arch support (not shown).

In the embodiments illustrated in FIGS. 4-9, it is possible that sock liner 31, 32 and/or 33 could include chamfered corners at one or both sides of the edge where the sock liner is connected to the insole board and/or clear window.

Figure 10:
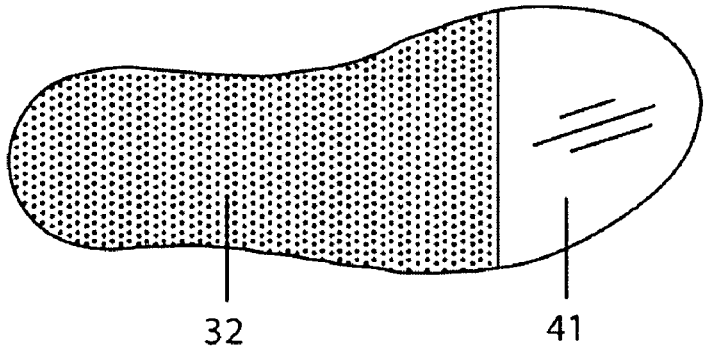
FIG. 10 is a plan view of still another alternative insole of the shoe of FIG. 1 in accordance with embodiments of the invention.
Figure 11:
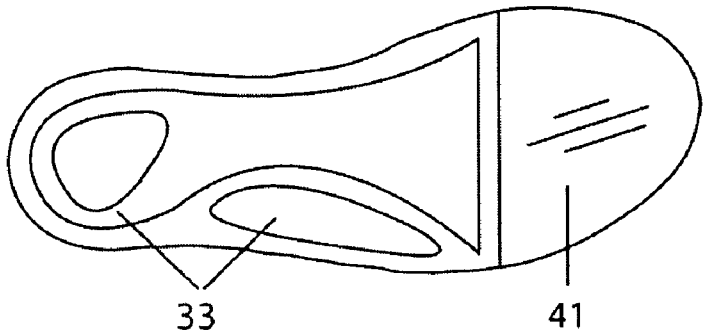
FIG. 11 is a plan view of an alternative insole of the shoe of FIG. 1 in accordance with embodiments of the invention.
Figure 12:
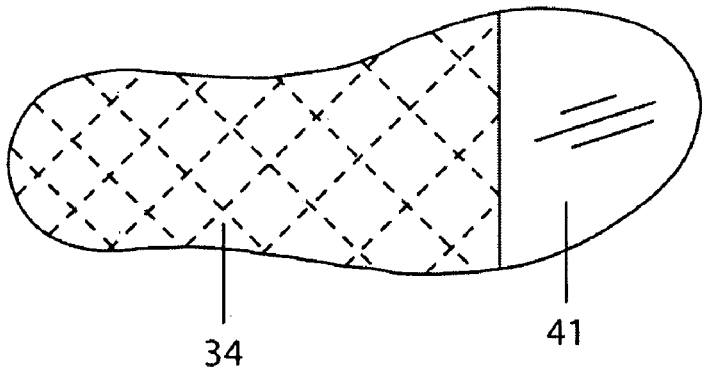
FIG. 12 is a plan view of another alternative insole of the shoe of FIG. 1 in accordance with embodiments of the invention.
Figure 13:
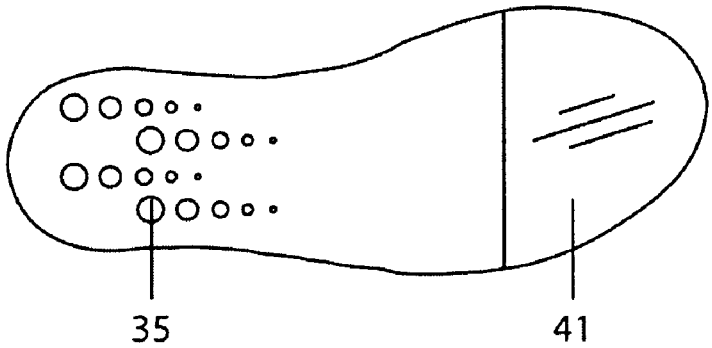
FIG. 13 is a plan view of another alternative insole of the shoe of FIG. 1 in accordance with embodiments of the invention.

FIGS. 10-13 illustrate embodiments of the invention that include an insole board 41 that is made of a clear material and is configured to be the same size as the bottom of the shoe. In FIG. 10, the sock liner 32 is made from a spray on flocking material. In FIG. 11, sock liner 33 is a heat embossed polyurethane pod or pods. Sock liner 34 of FIG. 12 is formed from a stitching pattern stitched to clear insole board 41 and sock liner 35 of FIG. 13 is silk screened to insole board 41. Those skilled in the art will recognize that while insole board 41 illustrated in FIGS. 10-13 are substantially flat, they could include an arch support (not shown) or a raised wall portion as illustrated for sock liner of FIG. 8 and still fall within the scope of the invention.

Figure 16:
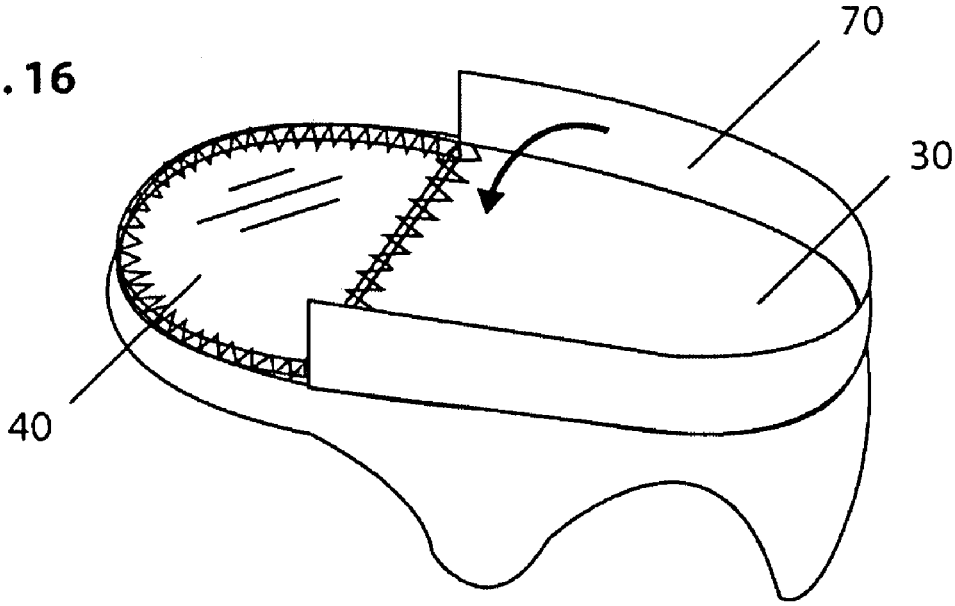
FIG. 16 is a perspective view of the insole of any of FIGS. 2-5 illustrating a method of attaching the insole to the upper of the shoe; and, FIG. 17 is a perspective view of the insole of any of FIGS. 2-5 illustrating the insole attached to the upper of the shoe.
Figure 17:
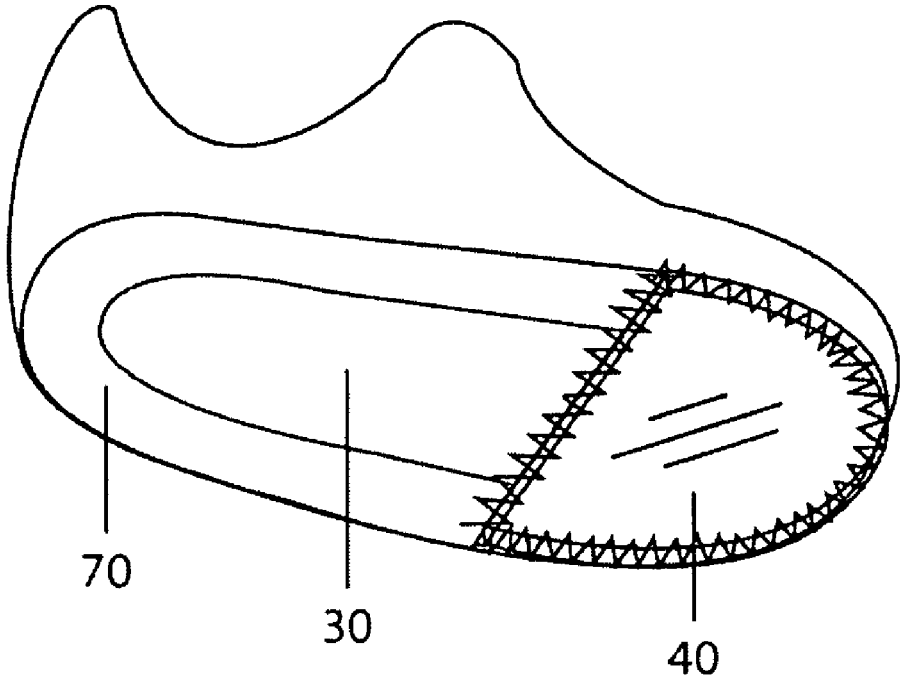

In any or all of the embodiments illustrated in FIGS. 1-15 and 18 the entire insole is preferably stroble stitched to the upper of the shoe. In the embodiments of FIGS. 4-9 preferably the sock liner is not stroble stitched to the upper of the shoe. Those skilled in the art will recognize that in any or all of the embodiments the window portion 40 could be stroble stitched and the remaining insole board (whether formed from the sock liner or not) could be cemented or glued to the upper of the shoe as illustrated in FIGS. 16 and 17. In these figures, the upper is lasted 70 or formed around sock liner/insole board 30 with glue/cement. With this method it is preferable, but not required, that the insole board 30 be tacked to the last 70 to avoid the upper from slipping, then removing the tack prior to adding the sole. Those skilled in the art will recognize that other methods of gluing/cementing the insole board to the upper are possible and considered to fall within the scope of the invention.

While the above description is limited to a specific preferred example, the invention is not so limited. While stroble stitching has been disclosed, other forms of stitching or other methods of attachment could be employed without departing from the scope of the invention. While the attachment between the clear window and the sock liner/insole board has been illustrated as a straight connection, it could be curved or zig zagged or fit like two connecting puzzle pieces and still fall within the scope of the invention. Although particular embodiments have been disclosed herein in detail, this has been done for purposes of illustration only, and is not intended to be limiting with respect to the scope of the claims, which follow. In particular, it is contemplated by the inventors that various substitutions, alterations, and modifications may be made without departing from the spirit and scope of the invention as defined by the claims. Other aspects, advantages, and modifications are considered to be within the scope of the following claims. The claims presented are representative of the inventions disclosed herein. Other, unclaimed inventions are also contemplated. The inventors reserve the right to pursue such inventions in later claims.

It is accordingly intended that all matter contained in the above description or shown in the accompanying drawings be interpreted as illustrative rather than in a limiting sense. It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A shoe comprising: an inside, a front toe portion, a rear heal portion, a sole having a clear window portion, an insole board and an insole with said insole further comprising:

a first section having a front side composed of a transparent material, rear side, left and right sides, top and bottom, configured to fit within said shoe in an arrangement in which said rear side faces the direction of the rear heal portion of the shoe and the front side is positioned proximal to said toe portion; and a second section representing a sock liner located above the insole board with said second section being interconnected to the insole board and to the rear side of said first section through common stitching extending from the left side to the right side of the first section, with at least a portion of each of said first and second sections forming a planar surface and with the transparent front side of the first section overlapping the clear window portion of the sole at a location adjacent the common stitching.

2. A shoe according to claim 1 wherein said insole board is connected to said first section of transparent material between the left and right sides thereof.

3. A shoe according to claim 2 wherein the second section representing the sock liner further includes a raised wall section.

4. A shoe according to claim 2 wherein the sock liner further includes a raised arch support.

5. A shoe according to claim 1 wherein the sock liner further includes a raised wall section.

6. A shoe according to claim 1 wherein the sock liner further includes a raised arch support.

7. A shoe comprising: an inside, a front toe portion, a rear heal portion, a sole, a clear window portion within said sole, and an insole with said insole further comprising:

a first section composed of a transparent material configured to fit within said shoe proximal said toe portion having a size substantially corresponding to the size of said clear window portion of the sole of the shoe with said first section having a rear side facing the direction of the rear heal portion of the shoe; and a second section representing a sock liner for said shoe, and an insole board located below the insole and being connected to said rear side of said first section in an arrangement such that the transparent first section and the insole board lie in a common planar surface with the transparent first section overlapping the clear window portion within the sole.

8. A shoe according to claim 7 wherein said insole board forms said is formed from a sock liner.

9. A shoe according to claim 7 wherein the sock liner further includes a raised wall section.

10. A shoe according to claim 9 wherein the sock liner further includes a raised wall section.

11. A method of attaching an insole to a shoe having an inside, a front toe portion, a rear heal portion, a sole having a clear window portion and an upper, and wherein the insole is formed by interconnecting two separate sections of the insole to each other with the first section being composed of a transparent material having a front side, rear side and left and right sides and with the second section forming a sock liner and an insole board for the shoe the method comprising:

stitching the first section to the second section to form stitches extending from the left to the right side thereof;

connecting the first section to the front toe of the shoe such that the transparent first section is proximal the front toe portion and overlaps the clear window portion to form overlapping portions with the stitching separating the overlapping portions from the insole board, and connecting the second section representing the sock liner and insole board to the upper.

12. The method according to claim 11 wherein said connecting the insole board to the upper includes gluing the insole board to the upper.

13. The method according to claim 11 wherein said connecting the insole board to the upper includes stitching the insole board to the upper.

* * * * *